US008850651B1

(12) United States Patent
Carman

(10) Patent No.: US 8,850,651 B1
(45) Date of Patent: Oct. 7, 2014

(54) MOP HEAD AND HANDLE

(71) Applicant: Edward W. Carman, Pittsgrove, NJ (US)

(72) Inventor: Edward W. Carman, Pittsgrove, NJ (US)

( * ) Notice: Subject to any disclaimer, the term of this patent is extended or adjusted under 35 U.S.C. 154(b) by 0 days.

(21) Appl. No.: 14/242,233

(22) Filed: Apr. 1, 2014

(51) Int. Cl.
*A47L 13/20* (2006.01)
*A47L 13/24* (2006.01)

(52) U.S. Cl.
CPC ..... *A47L 13/24* (2013.01)
USPC ..... 15/228; 15/231; 15/244.1; 15/244.2; 15/244.3; 15/247

(58) Field of Classification Search
USPC ..... 15/228, 231, 232, 244.1, 244.2, 244.3, 15/245, 247
See application file for complete search history.

(56) References Cited

U.S. PATENT DOCUMENTS

| | | | | |
|---|---|---|---|---|
| 2,691,788 | A | 10/1954 | Thomasson | |
| 2,694,213 | A | 11/1954 | Thomasson | |
| 3,058,139 | A | 10/1962 | Dryden | |
| 3,274,635 | A * | 9/1966 | Myers | 15/244.2 |
| 3,491,397 | A | 1/1970 | Hesener | |
| 3,787,919 | A * | 1/1974 | Siemund | 15/244.1 |
| 5,343,587 | A * | 9/1994 | Findley | 15/228 |
| 5,351,356 | A | 10/1994 | Townsend, Jr. | |
| 5,435,040 | A | 7/1995 | McClure | |
| 5,678,278 | A * | 10/1997 | McBride et al. | 15/228 |
| 6,052,856 | A | 4/2000 | DeMoya et al. | |

* cited by examiner

*Primary Examiner* — Mark Spisich
(74) *Attorney, Agent, or Firm* — Norman E. Lehrer

(57) ABSTRACT

A mop head and handle combination includes a block of substantially rigid foam material with a cylindrically shaped cavity in the interior that extends the length thereof. An elongated slot in said top wall extends downwardly and communicates with the cavity. The width of the slot is less than the diameter of the cavity. The handle includes a vertical pole with a horizontal bar connected to the bottom end forming a T configuration. The handle can be connected to the mop head by aligning the bar with the slot and pushing down on the pole to force the bar through the slot and into the cavity. The portions of the block around the slot flex out of the way to allow the bar to pass therethrough and then flex back to their normal position to maintain the bar in place within the cavity.

9 Claims, 6 Drawing Sheets

MOP HEAD AND HANDLE

BACKGROUND OF THE INVENTION

The present invention is directed toward the combination of a mop head and handle and more particularly, toward such a combination that allows the handle to be easily and quickly attached to or detached from the mop head and which allows the handle to be moved relative to the head so that the head can be easily moved about a floor or other surface being mopped. In addition, the mop head can be fitted with a towel or towel-like material for mopping a floor.

Mops have, of course, been around for a very long time. For many years, the only mops that were available were essentially string or rope mops that included an elongated handle with a head with numerous strings or ropes hanging therefrom. Such mops were and are used with a bucket having a wringer attached to the top thereof. After a section of the floor is mopped, the mop is rinsed in the bucket of water or cleaning solution and wrung dry with the wringer. Such mops, buckets and ringers are shown, for example, in U.S. Pat. No. 5,440,778.

While such rope or string mops provide some function, they do suffer from numerous deficiencies. First, they are somewhat difficult to maneuver and they require substantial dexterity to simultaneously operate the wringer while lifting the mop through the wringer. Even further, the bucket of water simply gets dirty very quickly whereby dirty water is then being put back onto the floor.

Sponge mops with built-in wringers such as shown in U.S. Pat. No. 3,014,230 have also been known for some time. These mops include an elongated handle with a rectangular sponge affixed to one end with a pressure plate pivoted to the device that can compress the sponge to squeeze dirty water therefrom. The sponge on such sponge mops, however, is relatively small and the handle is fixed thereto so that it can move in only one direction.

It has also been proposed to provide a block of foam material with an opening through the center thereof into which a handle can be inserted. Such sponge mops are shown, for example, in U.S. Pat. Nos. 2,691,788 and 2,694,213. In these arrangements, however, the handle is fixed and cannot move relative to the mop. Furthermore, the mop must be tied to the handle in order to secure the same in place.

It is sometimes also desirable to simply push water or other liquid off the floor or other horizontal surface without actually mopping the same up. Such devices are commonly referred to as "squeegees" and one such device is shown, for example, in U.S. Pat. No. 4,386,443.

To Applicant's knowledge, there is no device available that adequately functions as a squeegee and a mop that allows the mopping material to be easily and quickly removed from the mop for cleaning and which allows the mop head to be easily removed from the handle for cleaning or replacement, when necessary. There is, therefore, a need for such an apparatus.

SUMMARY OF THE INVENTION

The present invention is designed to overcome the deficiencies of the prior art discussed above. It is an object of the present invention to provide a combined mop head and handle that can be easily assembled for use or easily disassembled for cleaning.

It is another object of the present invention to provide a combined mop head and handle that can be used as a squeegee to move water or other liquid across or off a floor or other surface.

It is a still further object of the present invention to provide a combined mop and handle that can be used as a mop for cleaning up spilled liquids and the like and which can be easily cleaned.

In accordance with the illustrative embodiments demonstrating features and advantages of the present invention, there is provided a mop head and handle combination that includes a block of substantially rigid foam material with a cylindrically shaped cavity in the interior that extends the length thereof. An elongated slot in said top wall extends downwardly and communicates with the cavity. The width of the slot is less than the diameter of the cavity. The handle includes a vertical pole with a horizontal bar connected to the bottom end forming a T configuration.

The handle can be connected to the mop head by aligning the bar with the slot and pushing down on the pole to force the bar through the slot and into the cavity. The portions of the block around the slot flex out of the way to allow the bar to pass therethrough and then flex back to their normal position to maintain the bar in place within the cavity. The top wall of the block includes a pair of opposed grooves formed therein that extend from a position adjacent each of the side walls angularly downwardly to intersect the cavity. The groves allow a portion of the elongated pole to lie therein thereby allowing the handle to pivot to either side of the block. The combined block and handle can be used in the nature of a squeegee to effectively move water or other liquids across a floor or toweling material or the like can be attached to the block to act as a mop for soaking up liquids. Several methods for attaching the toweling material to the block are disclosed.

Other objects, features, and advantages of the invention will be readily apparent from the following detailed description of the preferred embodiments thereof taken in conjunction with the drawings.

BRIEF DESCRIPTION OF THE DRAWINGS

For the purpose of illustrating the invention, there is shown in the accompanying drawings forms which are presently preferred; it being understood that the invention is not intended to be limited to the precise arrangements and instrumentalities shown.

DETAILED DESCRIPTION OF THE PREFERRED EMBODIMENTS

Figure 1:
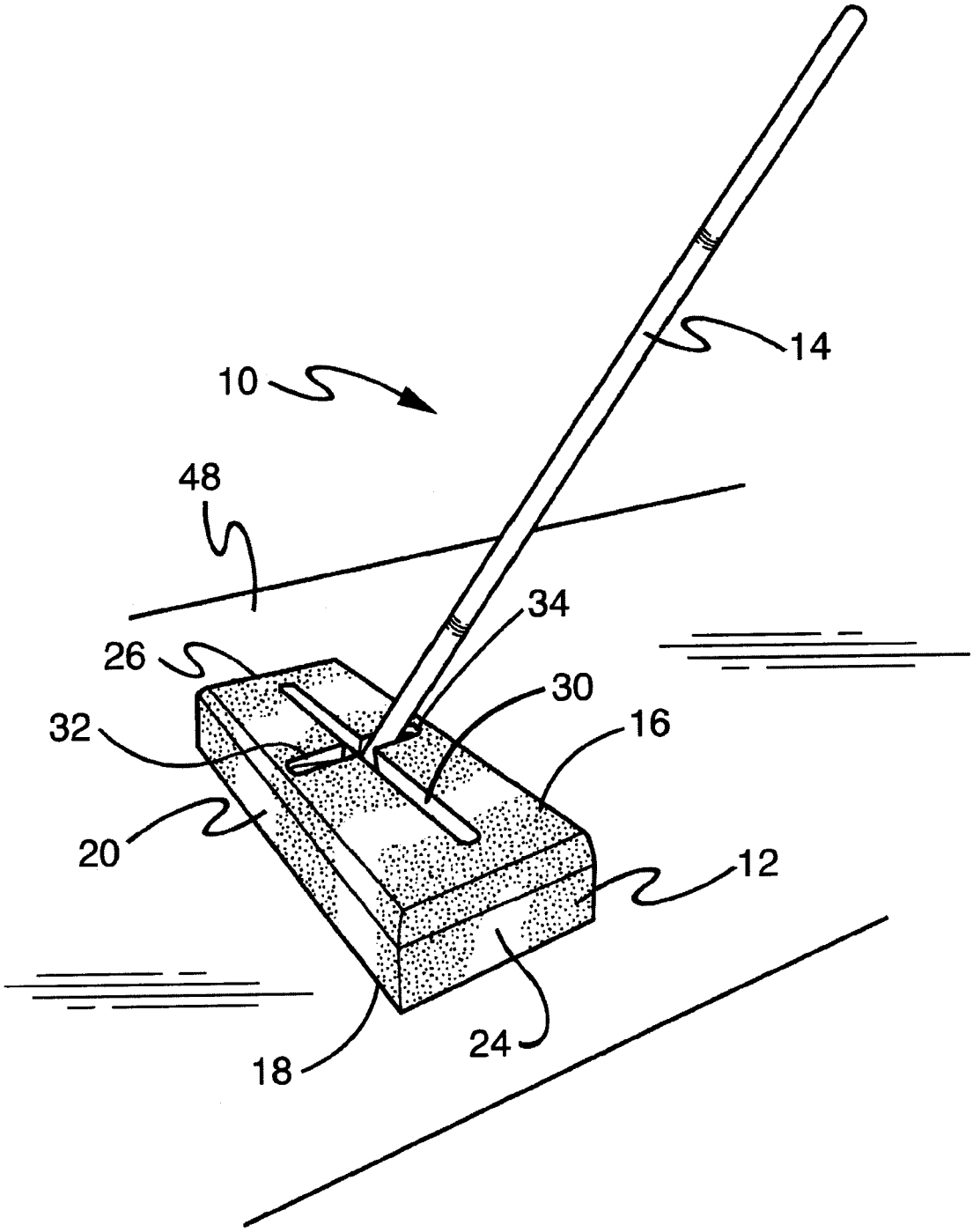
FIG. 1 is an end top perspective view of the combined mop head and handle of my invention and showing the same joined together.

Referring now to the drawings in detail wherein like reference numerals have been used throughout the various figures to designate like elements, there is shown in FIGS. 1-8 a combined mop head and handle constructed in accordance with the principles of the present invention and designated generally as 10. The combined mop head and handle 10 is comprised essentially of two component parts: a mop head in the form of a block 12 of substantially rigid foam material and a T-shaped handle 14.

The block 12 is essentially rectangular in shape and may have a length of approximately 12 to 18 inches, a width of between 6 and 10 inches and a height of between 3 to 6 inches. These dimensions, however, are by way of example only and other sizes may be possible. In any event, the block 12 is defined by a top wall 16, a bottom wall 18, front and back side walls 20 and 22 and end walls 24 and 26.

Figure 6:
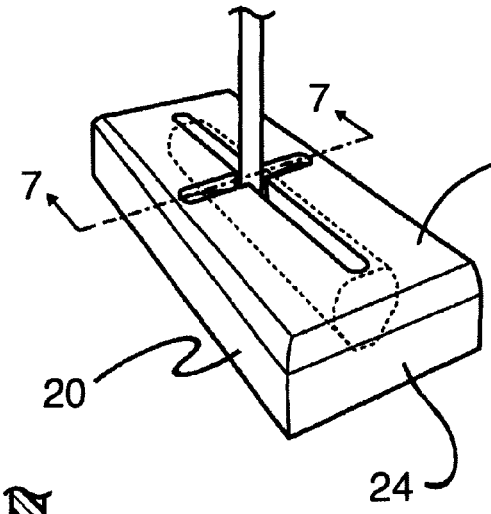
FIG. 6 is a view similar to FIG. 1 but showing the handle in a straight vertical position.
Figure 7:
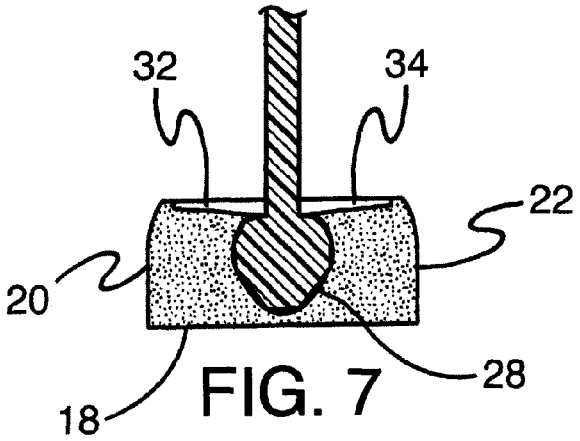
FIG. 7 is a cross-sectional view taken through the line 7-7 of FIG. 6.

As shown most clearly in FIGS. 6 and 7, a substantially cylindrically shaped cavity is formed in the interior of the block 12 and extends substantially throughout the length thereof. Formed in the upper wall 16 of the block 12 is an elongated slot 30 that extends from the top wall 16 downwardly and communicates with the interior cylindrical cavity 28. The length of the slot 30 is substantially the same as the length of the cavity 28. However, the width of the slot 30 is substantially less than the diameter of the cavity.

Opposed grooves 32 and 34 are formed in the top wall 16 perpendicular to the slot 30. Each of the grooves 32 and 34 begins in the top wall 16 adjacent the side wall 20 or the side wall 22 and extends angularly downwardly to intersect the slot 30 in the cavity 28.

Figure 2:
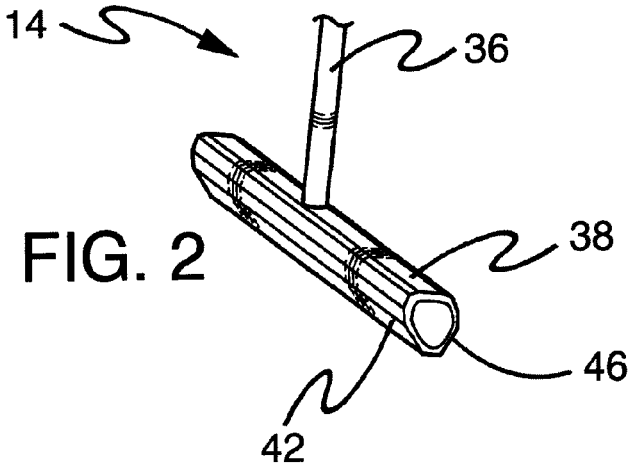
FIG. 2 is an end top perspective view of the mop handle separated from the mop head.
Figure 3:
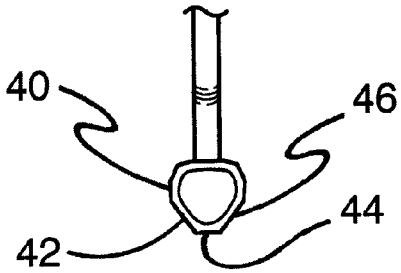
FIG. 3 is a side elevational view of the handle separated from the mop head.
Figure 4:
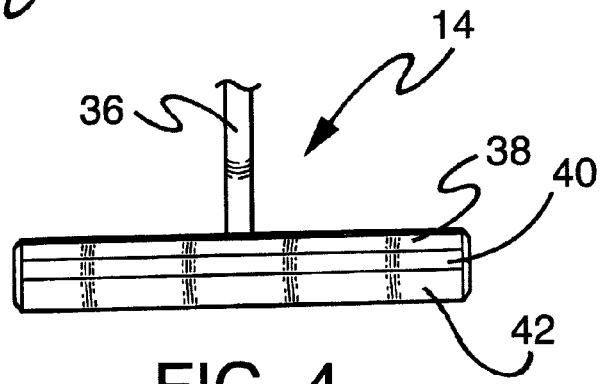
FIG. 4 is a front elevational view of the handle separated from the mop head.
Figure 5:
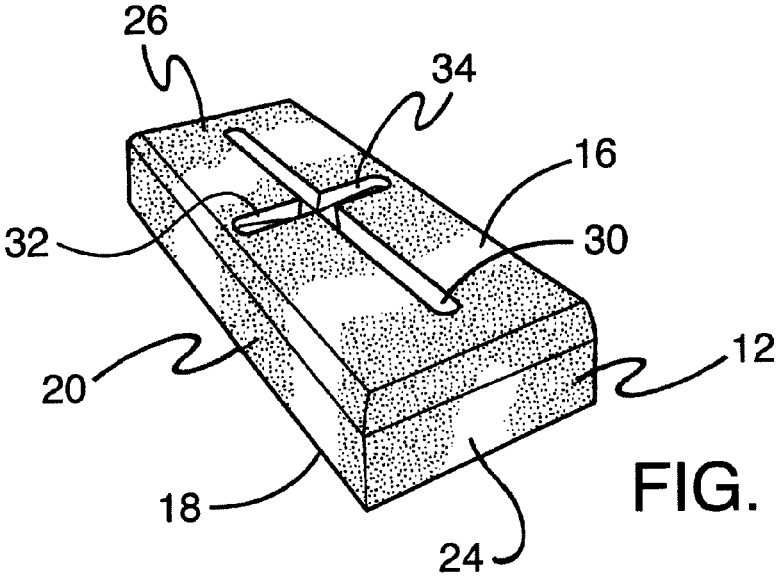
FIG. 5 is an end top perspective view of the mop head as shown in FIG. 1 but showing the mop head separated from the handle.

As shown best in FIGS. 2, 3 and 4, the handle 14 includes a substantially vertically extending elongated pole 36 and a substantially horizontally extending substantially cylindrically shaped bar 38 secured to the bottom end of the pole 36. The pole 36 and bar 38 essentially form an inverted T. While the bar 38 is substantially cylindrically shaped, it preferably has a number of flat surfaces formed thereon such as shown at 40, 42, 44 and 46 as best shown in FIG. 3.

The length of the bar 38 is substantially equal to the length of the cavity 28 formed in the block 12. However, the diameter or width of the bar 38 is greater than the width of the slot 30 formed in the top wall 16 of the block 12.

From the foregoing, it should be readily apparent to those skilled in the art that the combined mop head 12 and handle 14 are assembled by aligning the bar 38 with the slot 30 formed in the top wall 16 of the block 12 and pushing the same downwardly. The tapered shape of the bottom of the bar 38 which is formed by the walls 42 and 46 force the portions of the block 12 around the slot 30 to flex out of the way to allow the bar 38 to pass therethrough until it rests within the cavity 28. At that point, the walls of the slot 30 flex back to their normal position to maintain the bar 38 in place within the cavity 28.

Once the bar 38 is positioned within the cavity 28, the pole 36 of the handle 14 can be tilted toward either of the side walls 20 or 22 such as shown in FIG. 1. In this position, the pole 36 lies within the groove 34. The width of the groove 34 is, of course, of sufficient size to allow the pole 36 to rest therein.

When the combination of the mop head and handle 10 is assembled in the manner shown in FIG. 1, for example, the same can be used as a squeegee for moving water or other liquids across a floor or other surface 48. The handle 14 can be easily moved in the opposite direction by simply swinging the pole 36 to the other side so that it rests within the grove 32.

When it is desired to utilize the combination as a mop, a towel or towel-like material or substantially any other similar fabric 50 can be laid on the floor over the area to be mopped. The block 12, with the handle 14 attached thereto, is then placed onto the towel and the towel can be moved around the floor to clean up the spill or the like. When the towel is soiled, it is simply tossed into the wash.

Figure 8:
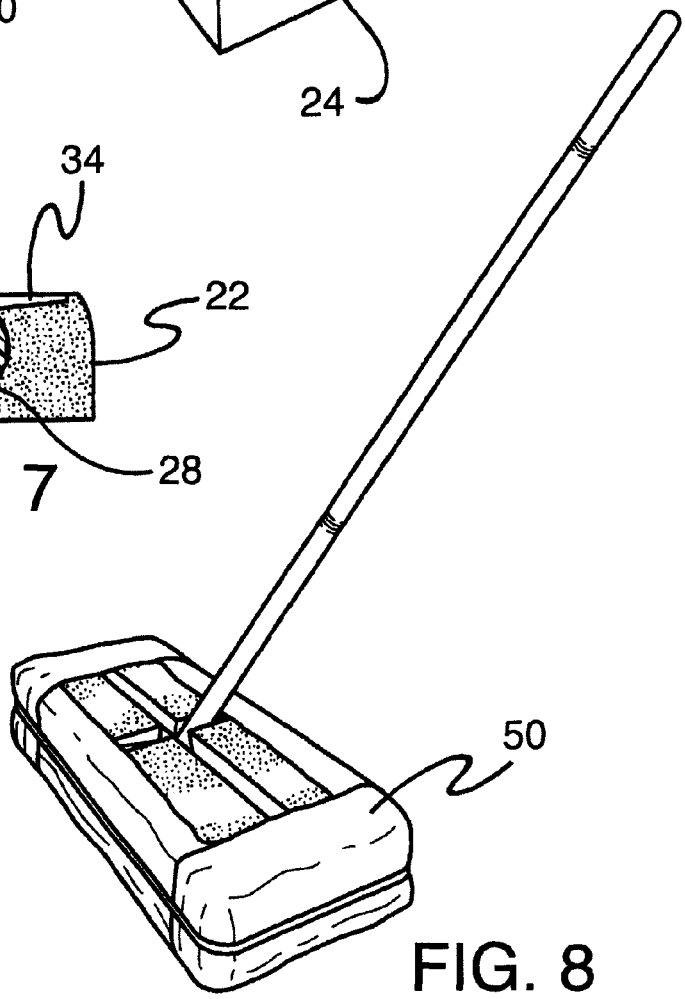
FIG. 8 is a view similar to FIG. 1 but showing a towel or similar material secured to the block so that the combination can be used as a mop.

Alternatively, a towel 50 can be wrapped around the block 12 as shown in FIG. 8. The towel 50 can be maintained in place through an elastic band or the like 52 that surrounds the sides and ends of the block 12. Once the towel has been soiled, it can be easily cleaned by simply removing the band 52 and the towel 50 from the mop head and washing the same in a standard washing machine. Furthermore, if it is ever desired to wash the block 12, the handle 14 can be easily removed therefrom by holding the block down in place while lifting the handle vertically upwardly.

FIGS. 9-13 illustrate additional ways in which the towel 50 can be connected to the mop head or block 12. In each case, a plastic cover 54 is provided which has an interior space substantially equal to the size and shape of the block 12. The cover 54 includes a top 56 and a descending front wall 58, a rear wall (not shown) and opposed descending end walls such as shown at 60.

The top 56 includes an opening 62 therein which corresponds essentially to the slot 30 and grooves 32 and 34 in the block 12. In some embodiments, however, it is possible to utilize only the portion of the opening 62 corresponding to the grooves 32 and 34 of the block 12. The lengthwise opening may not be needed as will become clear hereinafter.

Figure 10:
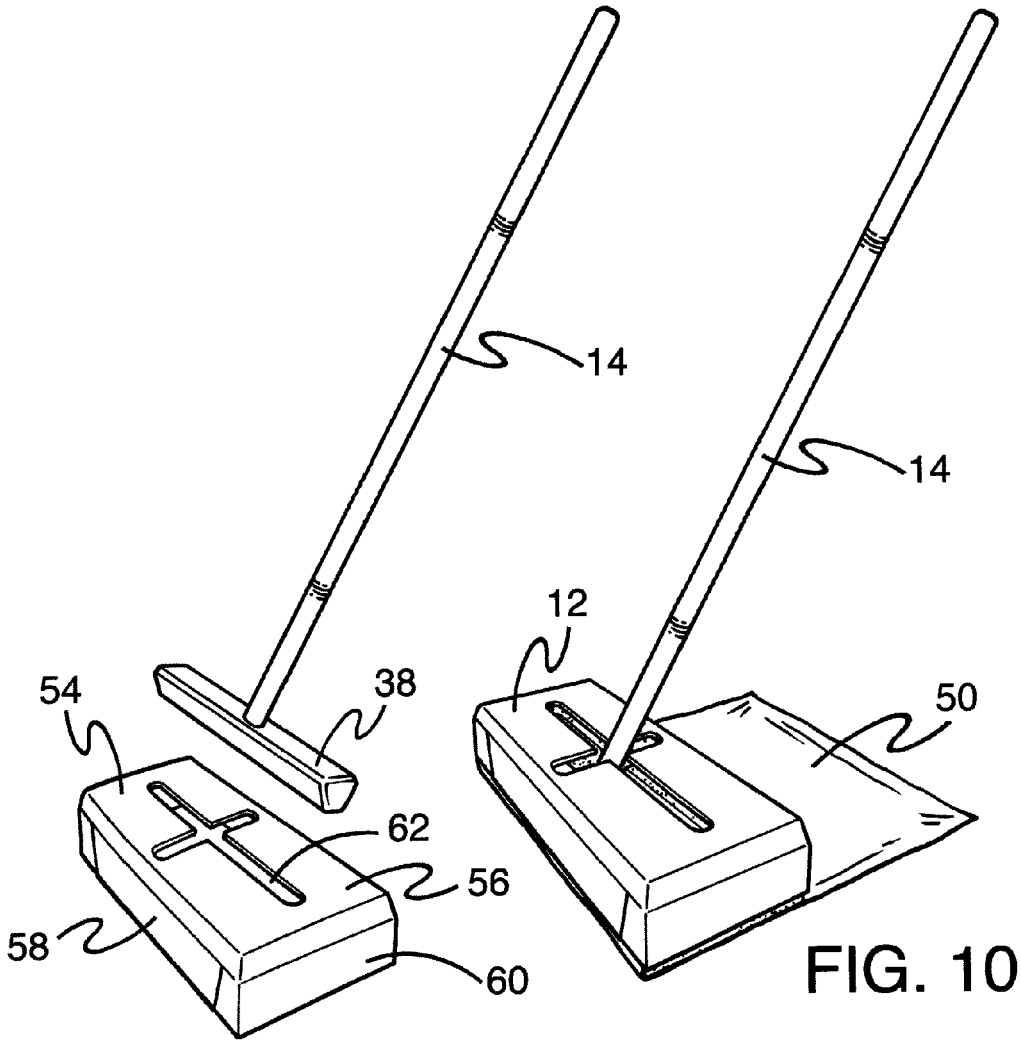
FIG. 10 is an assembled front perspective view of the embodiment of FIG. 9.
Figure 9:
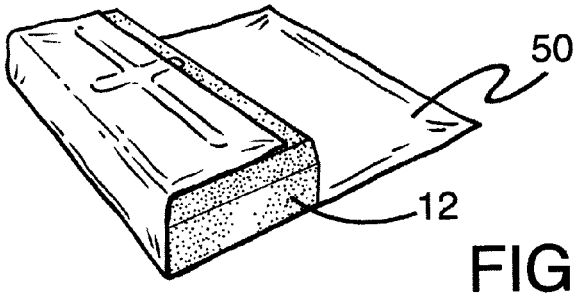
FIG. 9 is an exploded view of another embodiment of the invention which also includes a towel.

In the embodiment shown in FIGS. 9 and 10, the towel 50 is secured to the block 12 by placing the towel on the floor and wrapping one end of the towel up and around to the top surface of the block 12 as shown in FIG. 9. Thereafter, the cover 54 is pressed down over the forward edge of the towel and block 12 and a friction fit holds the two together. The handle 14 can then be pressed down into place as in the previous embodiment. As pointed out above, if only a portion of the slot 62 is provided that corresponds with the grooves 32 and 34 or if the slot 62 is made to be relatively narrow, the cover 54 can still be utilized by simply sliding the same down from the top end of the handle 14.

Figure 12:
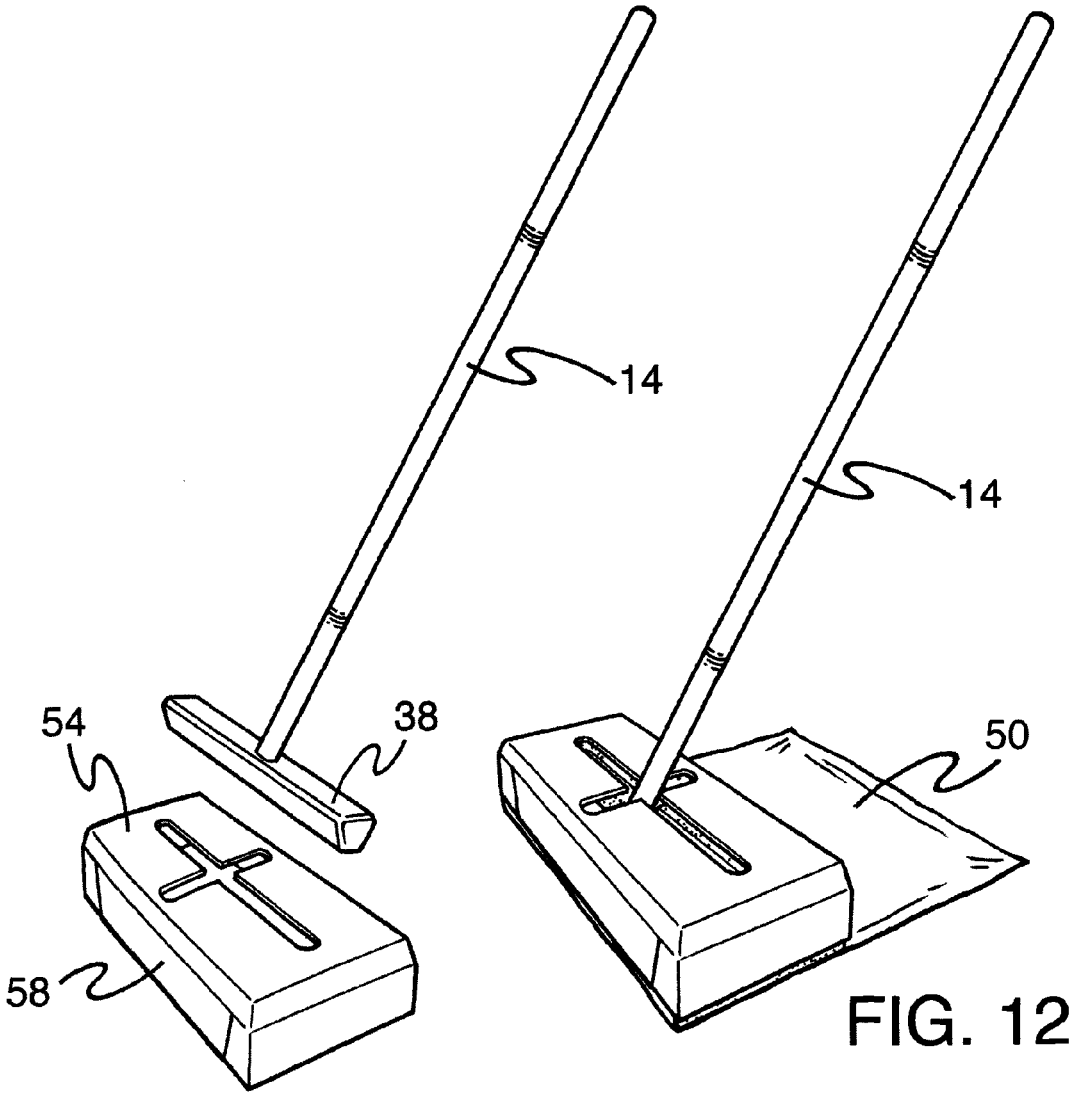
FIG. 12 is an assembled front perspective view of the embodiment of FIG. 11.
Figure 11:
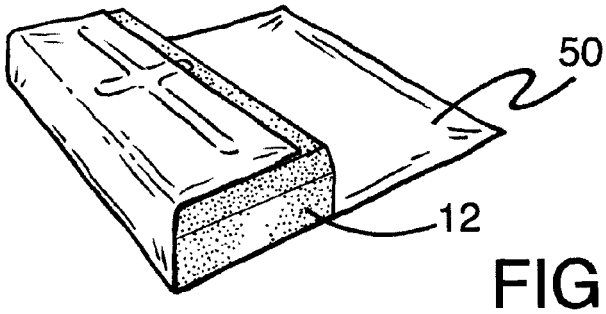
FIG. 11 is an exploded view of a still further embodiment of the invention which uses a towel.

The embodiment shown in FIGS. 11 and 12 is very similar to that shown in FIGS. 9 and 10. As can be seen, however, more of the towel is wrapped over the top of the block 12. When the handle is pressed down into place into the slot 30 of the block 12, a more secure grip of the towel is accomplished. It should be noted, that with the embodiment shown in FIG. 11, the cover 54 could, in many cases, be dispensed with. The cylindrically shaped bar 38 of the handle will hold the towel in place within the slot 30 even without the cover 54. It is also within the scope of the invention to first assemble the cover 54 onto the block 12, wrap a portion of the towel 50 over the top of the combination and then press the handle down into place through the slot 62 and into the slot 30.

Figure 13:
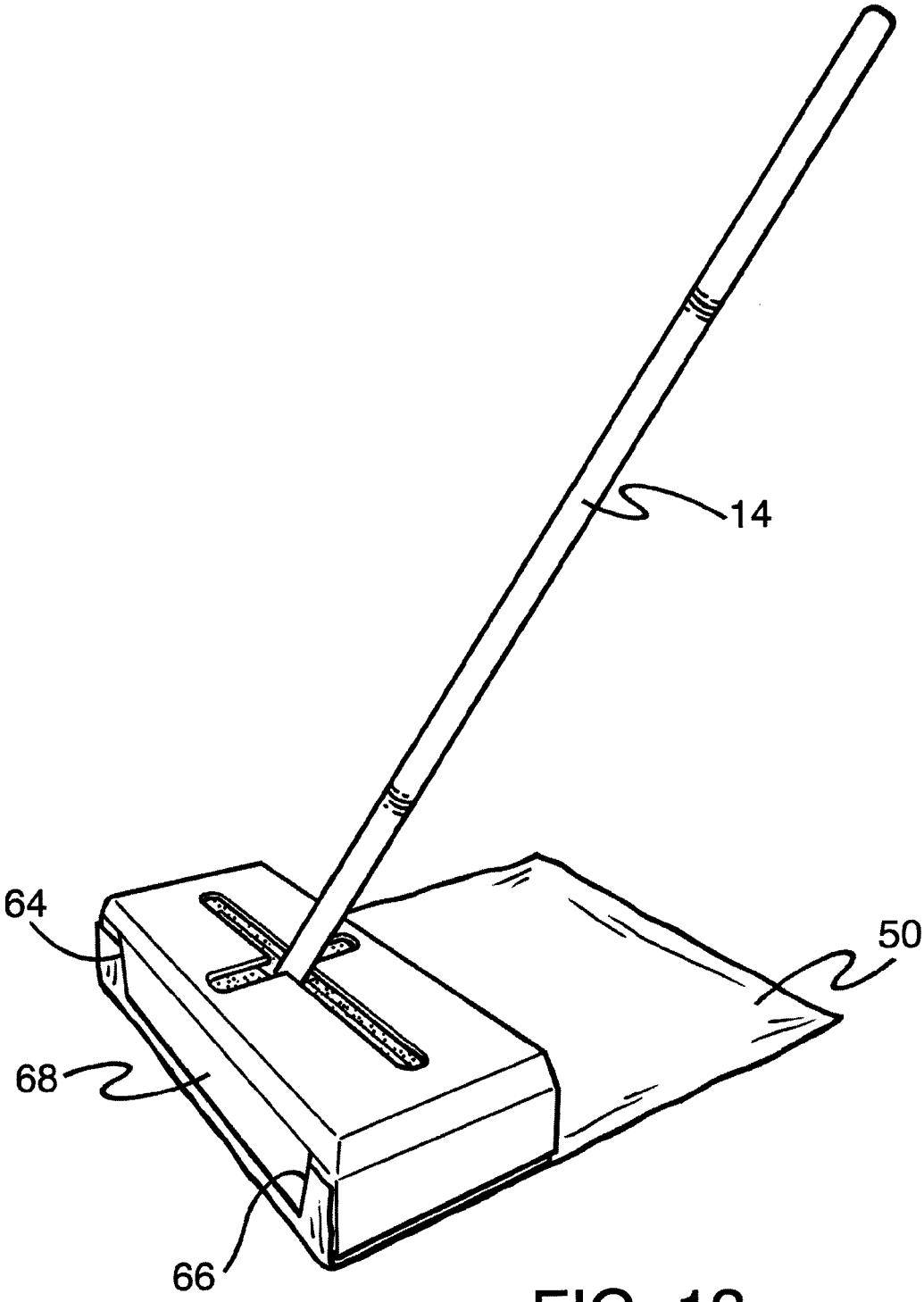
FIG. 13 is a front perspective view of an even further embodiment of the invention

An even further embodiment of the invention and an additional manner for holding the towel in place so that the same can be used as a mop is shown in FIG. 13. As shown therein, the front wall 58 is cut along a substantial portion of the height thereof at each end as shown at 64 and 66. This creates a flap 68 at the center and covering substantially the entire length of the front wall. As shown in FIG. 13, the forward end of the towel 50 can then be slid up under the flap 68 where it is held in place.

The present invention may be embodied in other specific forms without departing from the spirit or essential attributes thereof and accordingly, reference should be made to the appended claims rather than to the foregoing specification as indicating the scope of the invention.

I claim:

1. A mop head and handle combination comprising:

said mop head being comprised of a substantially rectangularly shaped block of substantially rigid foam material and having a length, a width and a height defined by a top wall, a bottom wall, two side walls and two end walls;

a substantially cylindrically shaped cavity in the interior of said block that extends a substantial portion of the length thereof;

an elongated slot in said top wall extending from said top wall downwardly and communicating with said cavity, the length of said slot being substantially commensurate with the length of said cavity, the width of said slot being less that the diameter of said cavity;

said handle including a substantially vertically extending elongated pole having a top end and a bottom end; a substantially horizontally extending substantially cylindrically shaped bar connected to said bottom end of said pole, said pole and bar thereby forming a T configuration; the length of said bar being substantially the same as the length of said cavity and the diameter of said bar being substantially the same as the diameter of said cavity, the diameter of said bar being greater than the width of said slot formed in the top wall of said block, whereby said handle can be connected to said mop head by aligning said bar with said slot and pushing down on said pole to force said bar through said slot and into said cavity, the portions of said block around said slot flexing out of the way to allow said bar to pass therethrough and then flexing back to their normal position to maintain said bar in place within said cavity.

2. The mop head and handle combination as claimed in claim 1 further including a groove formed in said top wall and extending from the top wall adjacent one of said side walls angularly downwardly to intersect said cavity, said groove being so dimensioned and sized as to allow a portion of said elongated pole to lay therein.

3. The mop head and handle combination as claimed in claim 2 further including a groove formed in said top wall and extending from the top wall adjacent the other of said side walls angularly downwardly to intersect said cavity, said groove being so dimensioned and sized as to allow a portion of said elongated pole to lay therein.

4. The mop head and handle combination as claimed in claim 1 further including a piece of fabric comprised of towel like material carried by said block adapted to lie under said block for contacting the floor.

5. The mop head and handle combination as claimed in claim 4 further including means for attaching said fabric to said block.

6. The mop head and handle combination as claimed in claim 5 wherein said means for attaching includes a plastic cover for said block.

7. The mop head and handle combination as claimed in claim 6 wherein said plastic cover includes a top and downward extending front, rear and end side walls.

8. The mop head and handle combination as claimed in claim 7 further including an opening in the top of said cover permitting said handle to pass therethrough.

9. The mop head and handle combination as claimed in claim 8 wherein said front wall of said cover includes the said means for attaching said fabric to said block.

* * * * *